US007789711B2

(12) United States Patent
Wu

(10) Patent No.: US 7,789,711 B2
(45) Date of Patent: Sep. 7, 2010

(54) ROTATABLE ELECTRICAL INTERCONNECTION DEVICE

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 82 days.

(21) Appl. No.: 12/221,293

(22) Filed: Aug. 1, 2008

(65) Prior Publication Data

US 2010/0029096 A1 Feb. 4, 2010

(51) Int. Cl.
*H01R 25/00* (2006.01)

(52) U.S. Cl. ..... 439/640; 439/165

(58) Field of Classification Search ..... 439/640, 439/31, 173, 165, 638, 502, 171, 11–14, 439/954; 174/50
See application file for complete search history.

(56) References Cited

U.S. PATENT DOCUMENTS 3,190,978 A * 6/1965 Huget ..... 200/51 R
5,542,850 A * 8/1996 Frantz ..... 439/31
5,658,152 A 8/1997 Selker
6,193,522 B1 * 2/2001 Liao ..... 439/31
6,213,782 B1 * 4/2001 Derstine ..... 439/31
6,280,258 B1 * 8/2001 Frohlund ..... 439/700
6,343,957 B1 2/2002 Kuo et al.
6,695,620 B1 * 2/2004 Huang ..... 439/11
6,786,734 B2 * 9/2004 Yu ..... 439/11
6,991,467 B1 * 1/2006 Cheng et al. ..... 439/10
7,128,615 B1 * 10/2006 Liao ..... 439/640
7,172,428 B2 * 2/2007 Huang ..... 439/11

* cited by examiner

*Primary Examiner*—T C Patel
*Assistant Examiner*—Harshad C Patel
(74) *Attorney, Agent, or Firm*—Wei Te Chung; Andrew C. Cheng; Ming Chieh Chang

(57) ABSTRACT

An electrical interconnection device (100) includes a first connector (1), a second connector (2) electrically connected to the first connector via a number of wires (26); a hinge member (3) including a first engaging portion (30) connected with a second engaging portion (32), said first engaging portion fixed to the first connector, the second engaging portion pivoted with the second connector; and a positioning member (305) unitarily formed with the hinge member, said positioning member selectively engaged with corresponding positioning grooves (202) of the second connector while the first connector and the second connector rotated with respect to one another.

11 Claims, 9 Drawing Sheets

ROTATABLE ELECTRICAL INTERCONNECTION DEVICE

BACKGROUND OF THE INVENTION

1. Field of the Invention

The present invention generally relates to an electrical interconnection device, and more particularly to an electrical interconnection device which has two connector members interconnected together and capable of swiveling with respect to one another.

2. Description of Related Art

An electrical interconnection device is used for connecting two electronic devices. There are many different kinds of electrical interconnection devices, such as cable connector assembly and an electrical adapter. The cable connector assembly is mainly used for connecting two electronic devices relatively far away from each other; while the electrical adapter is utilized for connecting two electronic devices neighbored each other which usually have different I/O interfaces.

U.S. Pat. No. 6,343,957 issued to Kuo on Feb. 5, 2002 discloses a DVI electrical adapter for electrically connecting a monitor to a host computer having different interfaces. The electrical adapter includes a combined digital & analog receptacle connector, a digital-only plug connector, two printed circuit boards joined between the plug connector and the receptacle connector, an insulative housing insert molded over a center of the electrical adapter and a pair of elongated fasteners. The elongated fasteners project through two sides of the insulative housing and include a first fixing end and a second fixing end. The second fixing end engages with nuts of a complementary receptacle connector mounted on the host computer. The first fixing end has a threaded recess accepting screws from a cable plug connector attached to the monitor. However, the receptacle connector and the plug connector of the aforementioned electrical adapter are not able to swivel with respect to one another, which may restrict usage of the electrical adapter in certain field.

U.S. Pat. No. 5,658,152 issued to Selker on Aug. 19, 1997 introduces a swivel plug. The plug is has male and female plug portions which pivot 180 degree, with respect to one another about a common pivot axis between first and second positions. A plurality of male and female electrical contact pairs slidably engage one another and pivot about the common pivot axis. Male and female bodies, which receive the electrical contact pairs, also pivot with respect to one another about the common pivot axis. The male and female bodies and the male and female electrical contact pairs are arranged in a novel relationship to mutually retain one other for the pivotal movement. The swivel plug eliminates the need for an electrical cord between an adapter of a laptop computer and a wall receptacle which has a downwardly located ground receptacle or a wall receptacle which has an upwardly located ground receptacle. The swivel plug also enables plugging a computer adapter or a typical extension cord into a receptacle where there is a rigid space constraint. However, as there is no stop means equipped in the swivel plug, a relation between the male portion and the female portion is uncontrollable.

Hence, an improved electrical interconnection device is highly desired to overcome the aforementioned problems.

SUMMARY OF THE INVENTION

Accordingly, an object of the present invention is to provide an improved swiveled electrical interconnection device.

In order to achieve the object set forth, an electrical interconnection device in accordance with the present invention comprises a first connector; a second connector electrically connected to the first connector via a number of wires; a hinge member including a first engaging portion connected with a second engaging portion, said first engaging portion fixed to the first connector, the second engaging portion pivoted with the second connector; and a positioning member unitarily formed with the hinge member, said positioning member selectively engaged with corresponding positioning grooves of the second connector while the first connector and the second connector rotated with respect to one another.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
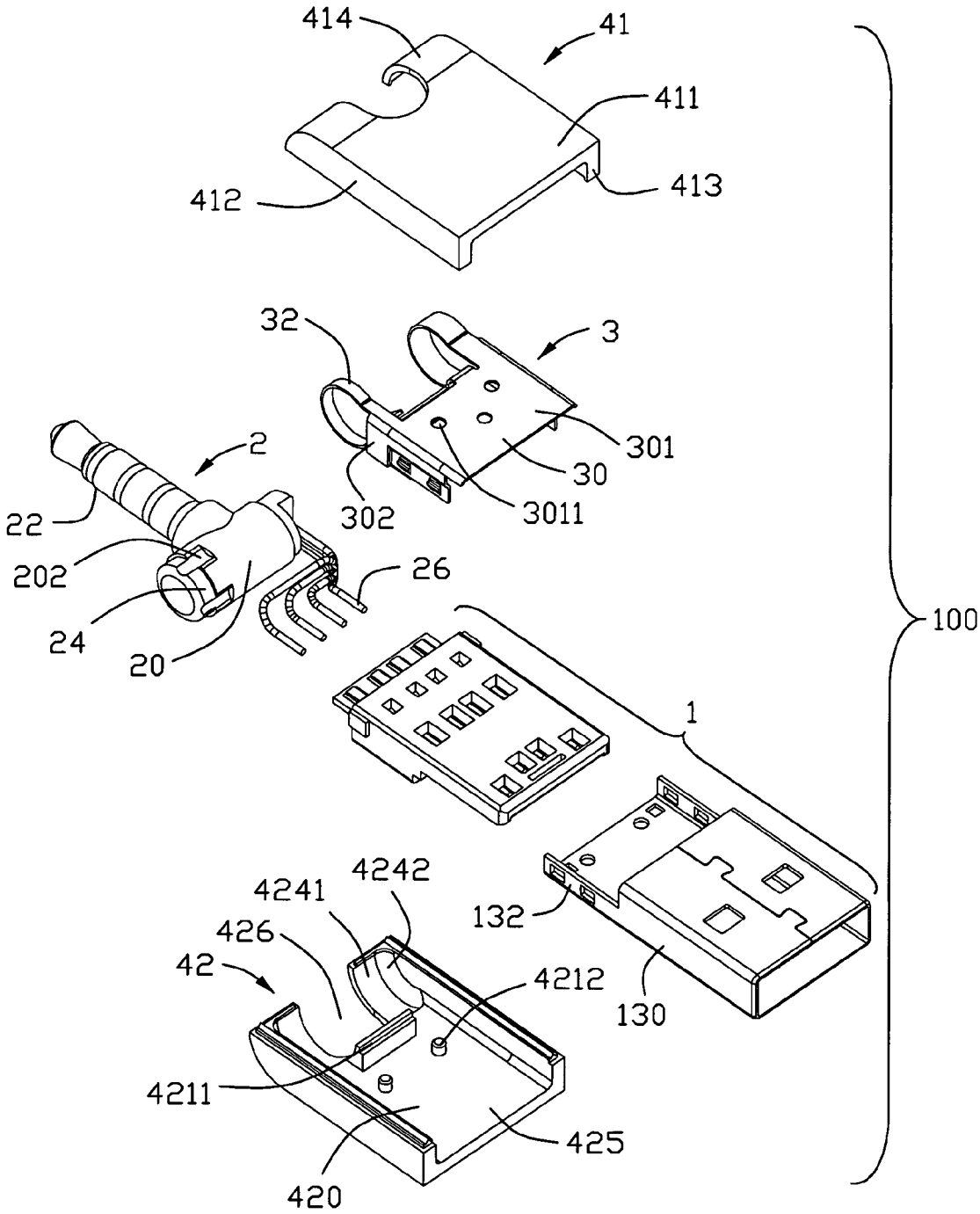
FIG. 1 is an exploded, perspective view of an electrical interconnection device in accordance with the present invention.
Figure 2:
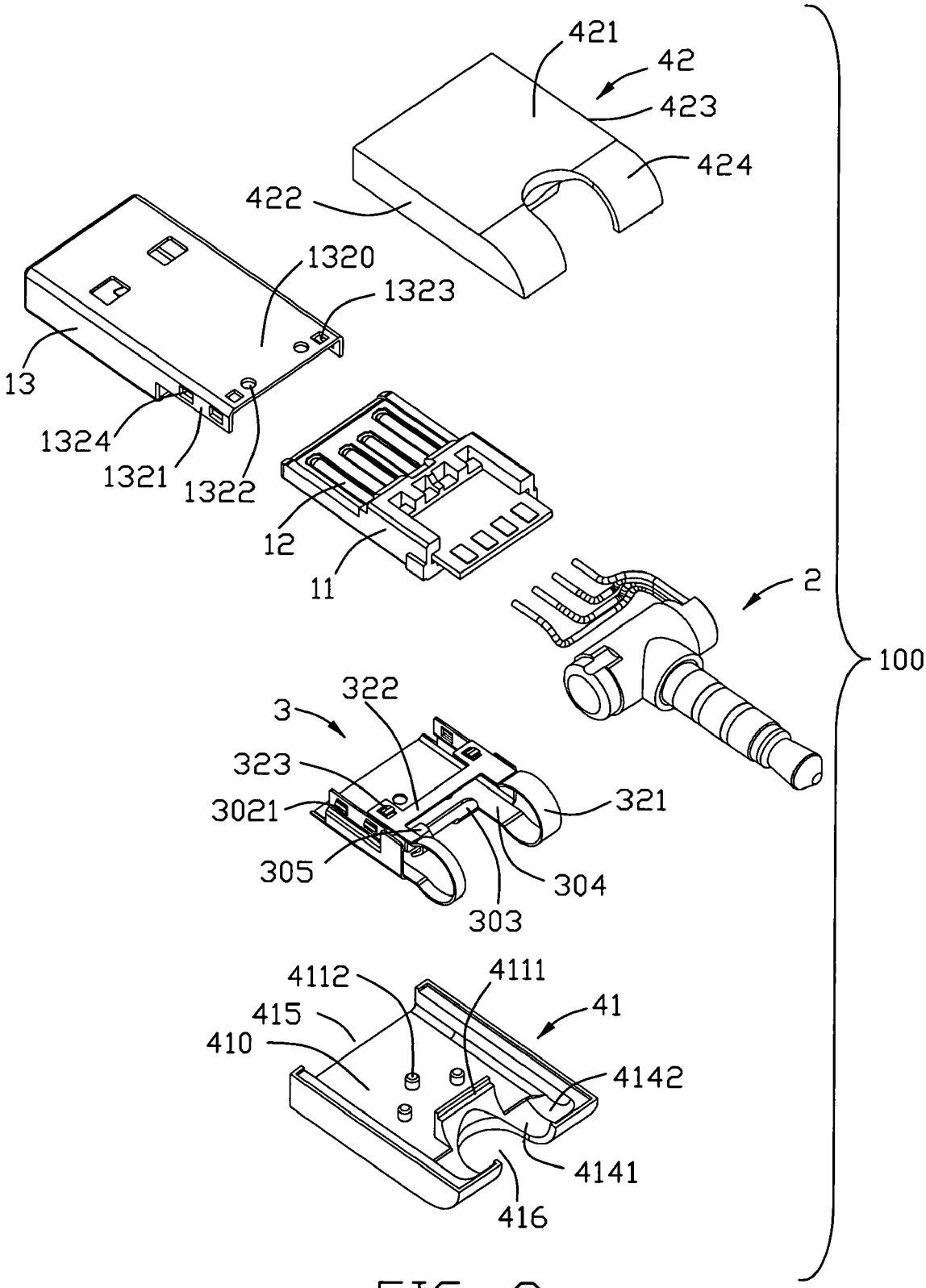
FIG. 2 is similar to FIG. 1, but viewed from another aspect.
Figure 3:
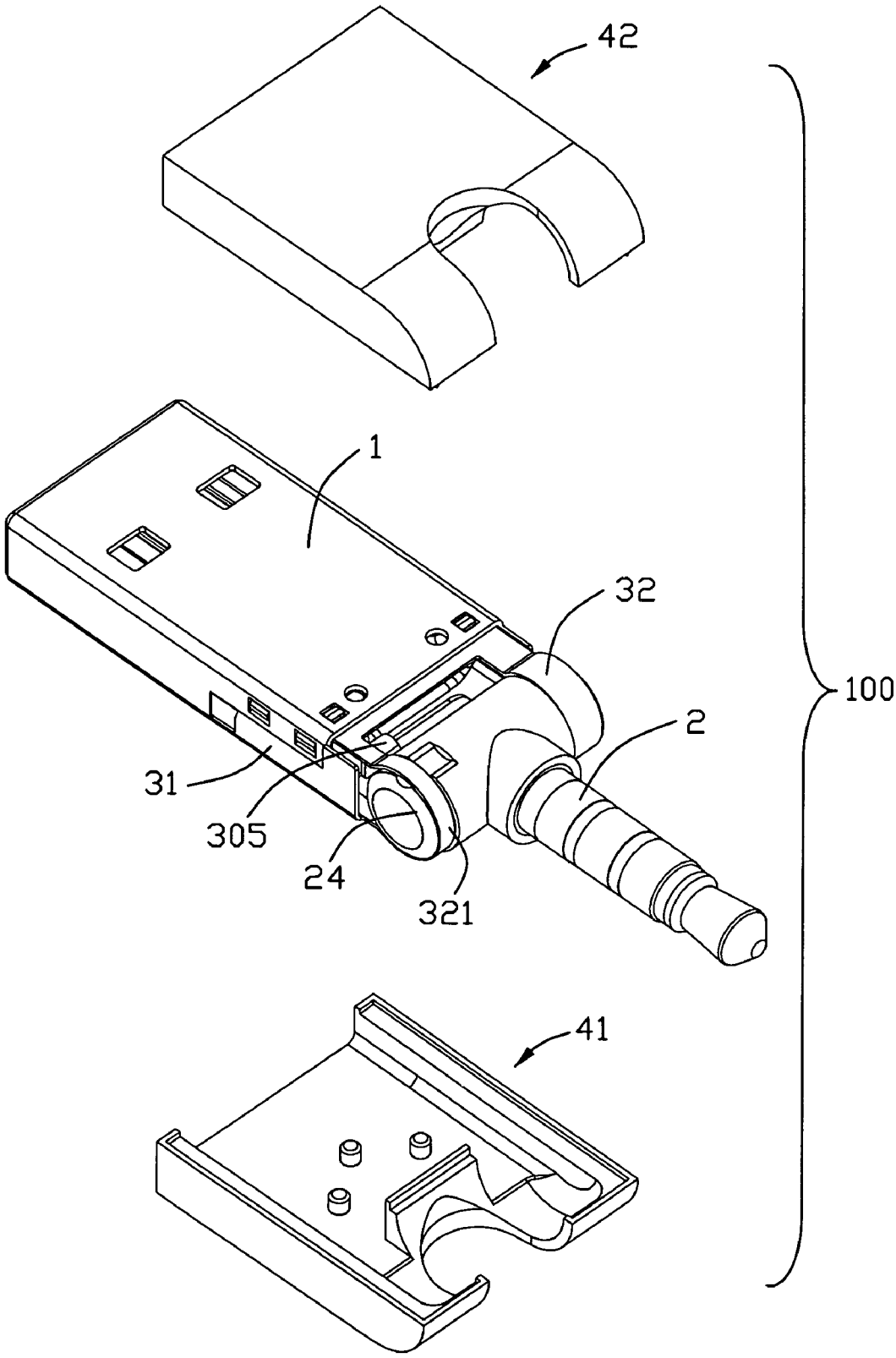
FIG. 3 is a partially assembled, perspective view of the electrical interconnection device.
Figure 4:
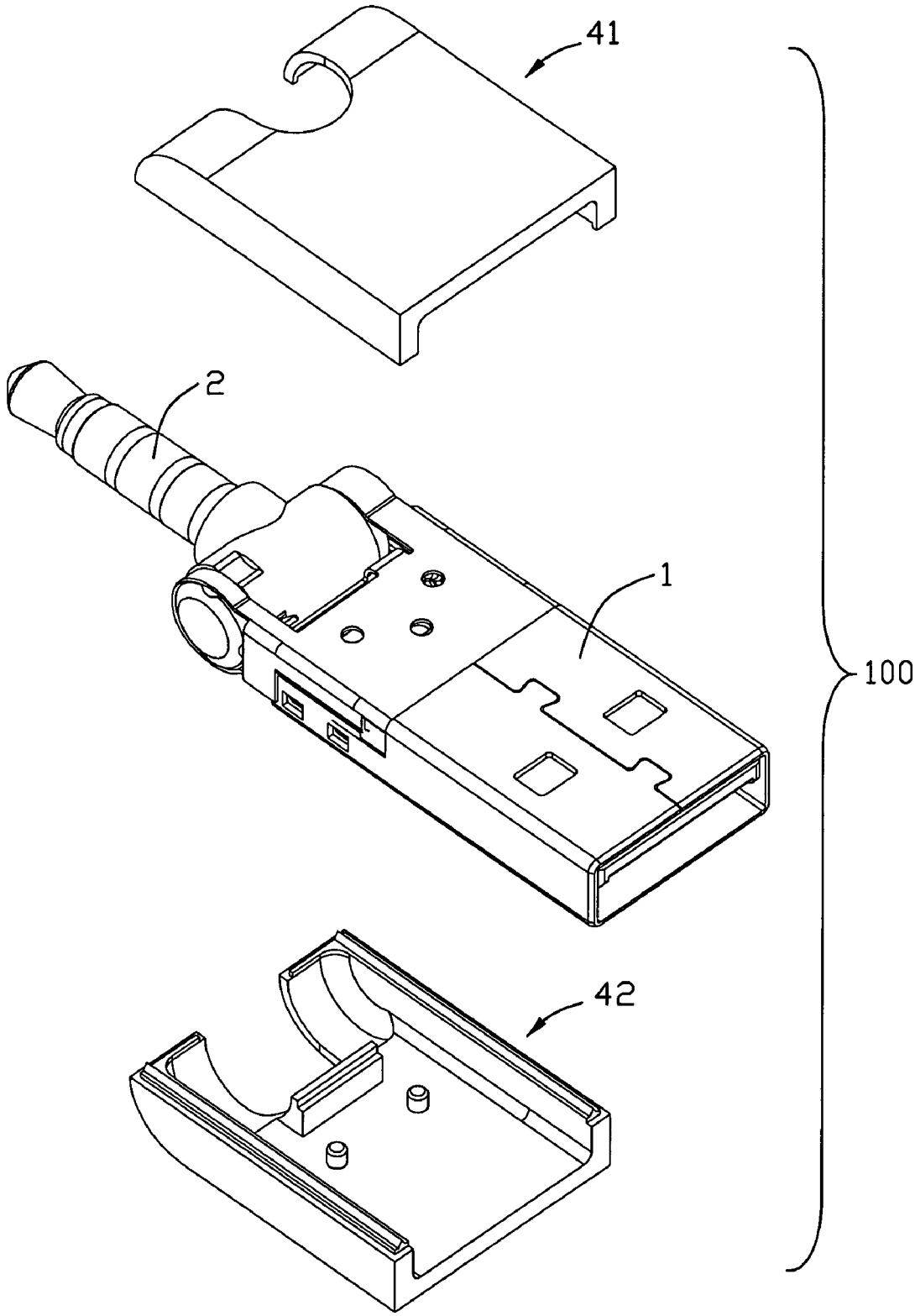
FIG. 4 is similar to FIG. 3, but viewed from another aspect.
Figure 5:
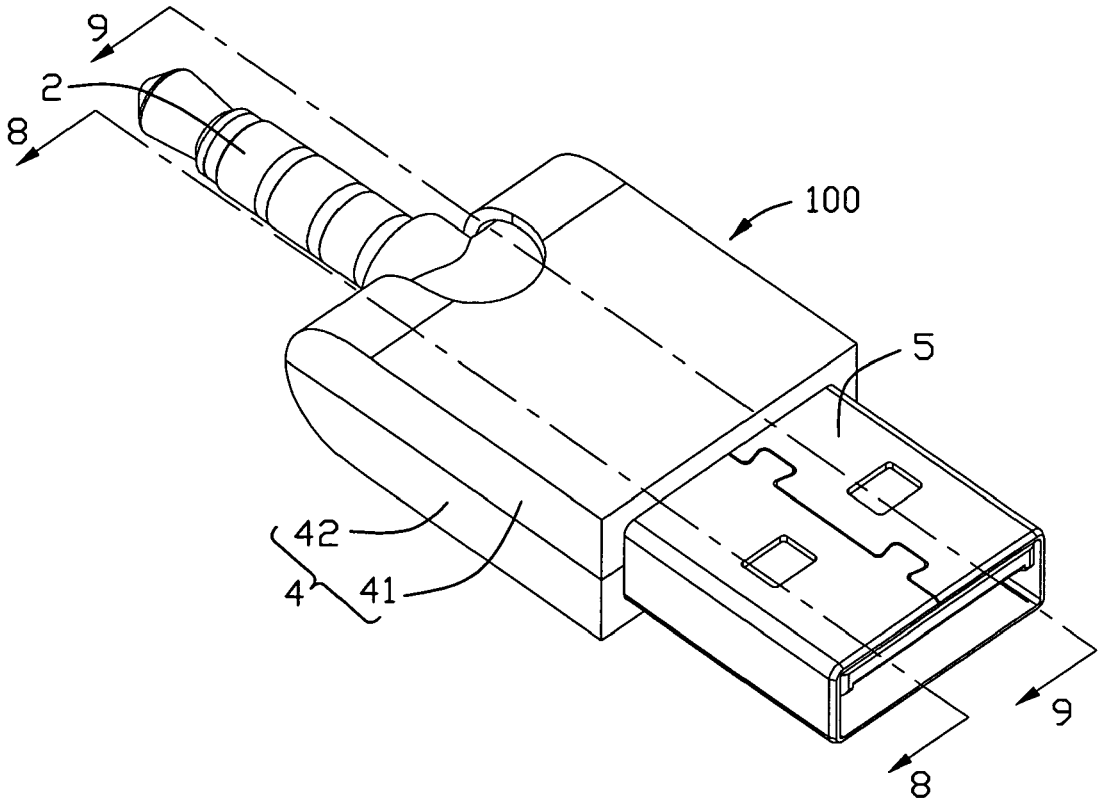
FIG. 5 is an assembled, perspective view of the electrical interconnection device.
Figure 6:
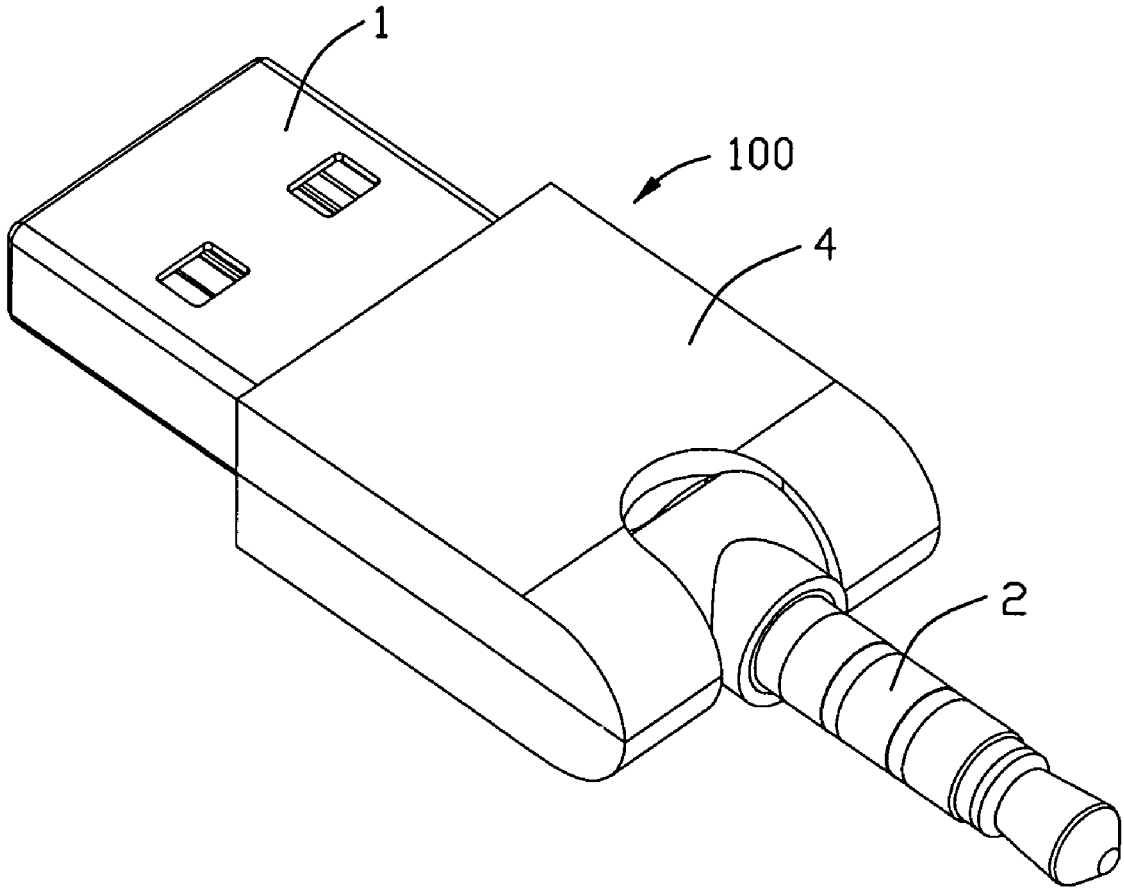
FIG. 6 is similar to FIG. 3, but viewed from another aspect.
Figure 7:
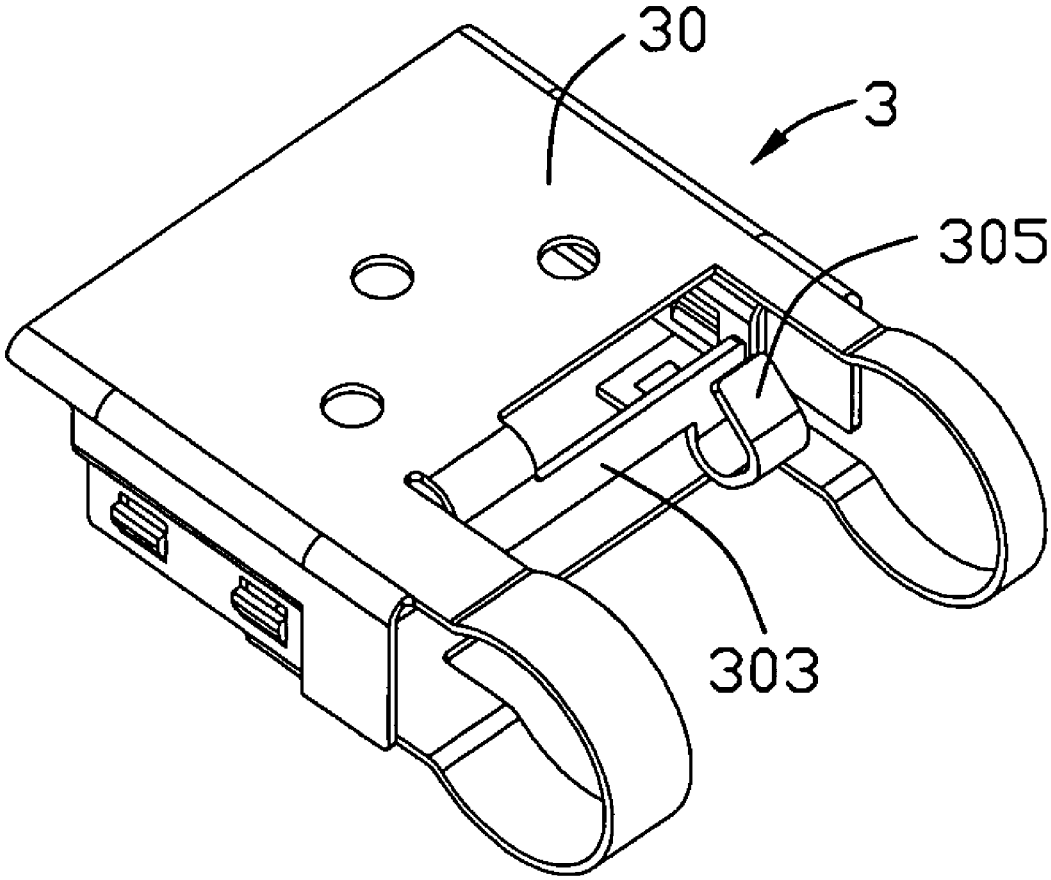
FIG. 7 is a hinge member of the electrical interconnection device.
Figure 8:
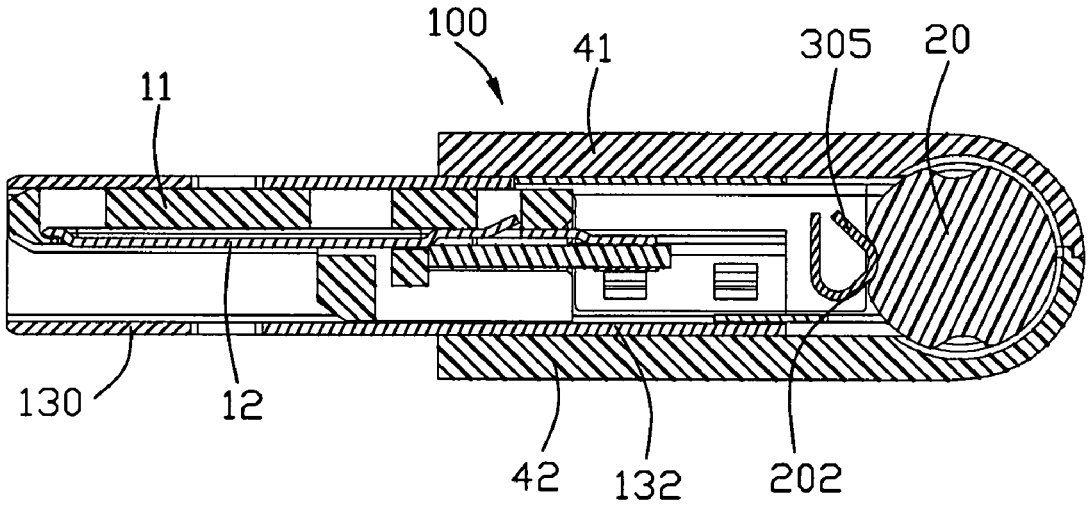
FIG. 8 is a cross-section view of FIG. 5 taken along line 8-8.
Figure 9:
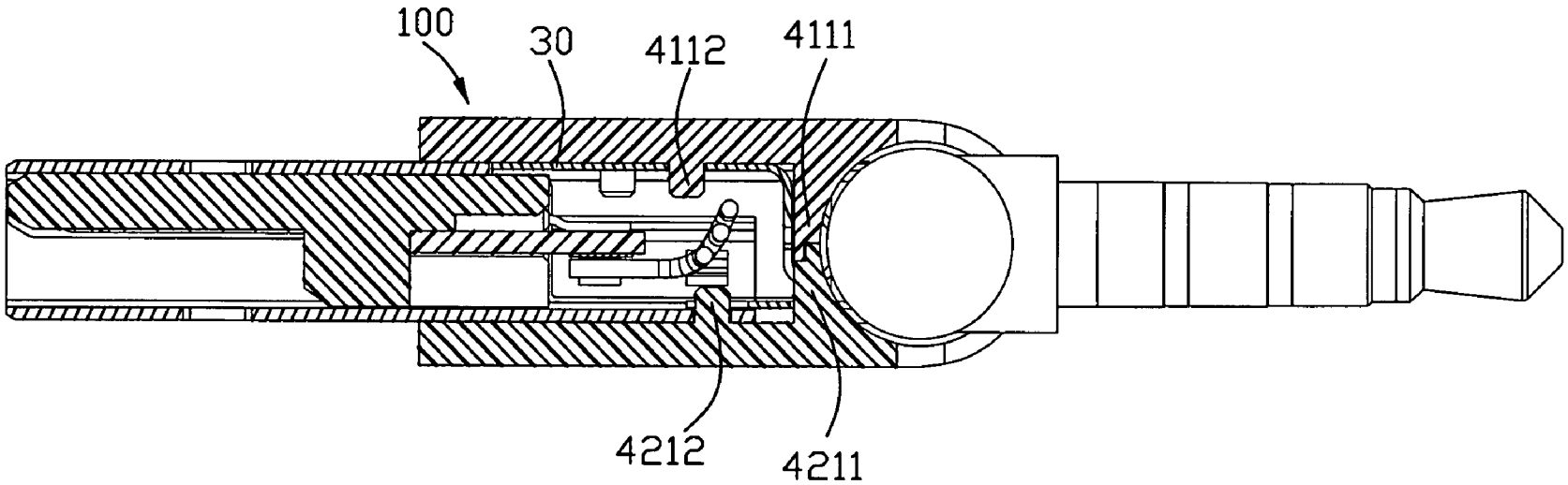
FIG. 9 is a cross-section view of FIG. 5 taken along line 9-9.

Referring to FIGS. 1-9, an electrical interconnection device 100 in accordance with the present invention comprises a first connector 1, a second connector 2 and a hinge member 3 linking the first connector 1 and the second connector 2, a cover 4 partially enclosing the first and second connectors 1, 2.

The first connector 1 is compatible with Universal Serial Bus (USB) transmitting protocol, however, it can be other types connector. The first connector 1 includes an insulated housing 11 and a number of contacts 12 mounted to the insulated housing 11 and a metallic shell 13 enclosing the insulated housing 11.

The metallic shell 13 includes rectangular shaped body portion 130 and a U-shaped engagement portion 132 extending rearward from bottom side and lower sections of lateral sides of the body portion 130. The engagement portion 132 has a bottom side 1320 and a pair of lateral sides 1321 extending upward from side edges of the bottom side 1320. A pair of circular-shaped holes 1322 are defined in a front section of a bottom side 1320. Two rectangular-shaped first retaining holes 1323 are defined in the front section of the bottom side 1320 and arranged outside of the holes 1322. Each of the lateral sides 1321 further defines two rectangular-shaped second retaining holes 1324 along a front-to-rear direction, disposed adjacent to the first retaining holes 1323.

The second connector 2 is an Audio Plug connector, however, it can be other types connector. The second connector 2 includes a cylindrical-shaped base portion (a columnar second base portion) 20 and a mating portion (a columnar second mating portion) 22 extending forwardly from the base portion 20 in a direction perpendicular to an axis of said columnar second base portion 20, and the columnar second base portion 20 is diametrically larger than the columnar second mating portion 22 along the axis. Two cam portions 24 are arranged at lateral sides of the base portion 20. A number of positioning grooves 202 are defined in a peripheral portion of the base portion 20 and adjacent to one of the cam portions 24. The positioning grooves 202 are separated from one another around the base portion 20. A number of wires 26 are connected to the mating portion 22 of the second connector 2 and further electrically connected to rear portions of the contacts 12.

The hinge member 3 is made of sheet metal and includes a first engaging portion 30 and a second engaging portion 32 connected to the first engaging portion 30. The first engaging portion 30 includes a top side 301, two lateral sides 302 extending downward from lateral edges of the top side 301. An L-shaped arm portion 303 extends downwardly from a back edge of the top side 301. A pair of stump portions 304 extend rearward from lateral sides of the top side 301, being arranged aside the arm portion 303. A positioning member 305 is unitarily formed on a free end of the arm portion 303 and projected rearward therefrom. Three circular holes 3011 are arranged to triangular shape and located in a middle section of the top side 301. A pair of first tabs 3021 are formed on an each lateral side 302. The second engaging portion 32 includes two ring-shaped coupling portions 321 connected to ends of the stump portions 304 and a substantially I-shaped (or H-shaped) bridging portion 322 connected to ends of the coupling portion 321. The bridging portion 322 is under the arm portion 303. A pair of second tabs 323 are located at rear ends of the bridging portion 322.

The cover 4 includes a first shield part 41 and a second shield part 42 holding the first and second connectors 1, 2.

The first shield part 41 includes a top wall 411, a pair of transversal walls 412, 413, and a rear wall 414 joined together to form a first receiving space 410. The first shield part 41 further has a front outlet 415 and a back outlet 416 respectively communicating with the first receiving space 410. Two first concave portions 4141 are respectively defined in an inner side of the rear wall 414 and located at lateral sides of the back outlet 416, while two second concave portions 4142 are also defined in the inner side of the rear wall 414 and respectively disposed outside of the first concave portions 4141. The first concave portions 4141 are deeper than the second concave portions 4142. Both the first and second concave portions 4141, 4142 have curved interior surface. A first stopper 4111 is located in the first receiving space 410 and extends downwardly from an inner side of a rear portion of the top wall 411. The first stopper 4111 has a curved back surface. Three first posts 4112 are located in the first receiving space 410 and formed on the inner side of the top wall 411. The first posts 4112 are aligned in triangular-shape and disposed in front of the first stopper 4111.

The second shield part 42 includes a bottom wall 421, a pair of transversal walls 422, 423, and a rear wall 424 joined together to form a second receiving space 420. The second shield part 42 further has a front outlet 425 and back outlet 426 respectively communicating with the second receiving space 420. Two first concave portions 4241 are respectively defined in an inner side of the rear wall 424 and located at lateral sides of the back outlet 426, while two second concave portions 4242 are also defined in the inner side of the rear wall 424 and respectively disposed outside of the first concave portions 4241. The first concave portions 4241 are deeper than the second concave portions 4242. Both the first and second concave portions 4241, 4242 have curved interior surface. A second stopper 4211 is located in the second receiving space 420 and extends upwardly from an inner side of a rear portion of the bottom wall 421. The second stopper 4211 also has a curved back surface. Two second posts 4212 are located in the second receiving space 420 and formed on the inner side of the bottom wall 421. The second posts 4212 are disposed in front of the second stopper 4211.

When assemble, the hinge member 3 is mounted to the first receiving space 410 of the first shield part 41, with the top side 301 laid on the inner side of the top wall 411, the first posts 4112 inserted through the holes 3011 in the top side 301, the arm portion 303 located in front of a front surface of the first stopper 4111, upper sections of the coupling portions 321 located in the second concave portions 4142, thus the first engaging portion 30 of the hinge member 3 is securely engaged with the first shield part 41. Secondly, the second connector 2 is assembled to the hinge member 3, with the cam portions 24 held by the coupling portions 321, an upper portion of the base portion 20 is located in the first concave portions 4141, a back portion of the base portion 20 riding/relying against the back surface of the first stopper 4111, the mating portion 22 extending out of the first shield part 41 via the back outlet 416. Thirdly, the first connector 1 is fastened/fixed to the hinge member 3, with the second tabs 323 locked into the first retaining holes 1323, the first tabs 3021 locked into the second retaining holes 1324. Thus, the first connector 1 is combined together with the hinge member 3. Fourthly, the second shield part 42 is assembled to the first shield part 41, with the second posts 4212 inserted into the holes 1322 in the bottom side 1320, a middle section of the bridging portion 322 disposed between the second stopper 4211 and the second posts 4212, lower sections of the coupling portions 321 located in the second concave portions 4242, a lower section of the base portion 20 is located in the first concave portions 4241, the back portion of the base portion 20 riding/relying against the rear surface of the second stopper 4211. Retaining means, such as glue or rivets is utilized to combine the first and second shield part 41, 42 together.

The cam portions 24 are pivotally engaged with the coupling portions 321 of the hinge member 3, thus the second connector 2 and the first connector 1 are capable of swiveling with respect to one another. Furthermore, the positioning member 305 joggles or engages with the positioning grooves 202, which have the second connector 2 angled stopping. By such arrangement, an orientation or position of the second contactor 2 may be selected, which is convenient for users.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. An electrical interconnection device, comprising:

a first connector;

a second connector electrically connected to the first connector via a number of wires;

a hinge member including a first engaging portion connected with a second engaging portion, said first engaging portion fixed to the first connector, the second engaging portion pivoted with the second connector; and a positioning member unitarily formed with the hinge member, said positioning member selectively engaged with corresponding positioning grooves of the second connector while the first connector and the second connector rotated with respect to one another;

wherein a metallic shell enclosing an insulated housing of the first connector, wherein the hinge member engages with the metallic shell;

wherein the first engaging portion includes a top side, two lateral sides extending downward from lateral edges of the top side, wherein at least a tab is formed on each of the lateral sides and locked into a hole defined in corresponding lateral side of the metallic shell.

2. The electrical interconnection device as claimed in claim 1, wherein the second connector includes a substantially cylindrical-shaped base portion and a mating portion extending forwardly from the base portion.

3. The electrical interconnection device as claimed in claim 2, wherein the positioning grooves are defined around peripheral side of the base portion.

4. The electrical interconnection device as claimed in claim 2, wherein two cam portions are arranged at lateral sides of the base portion and pivotally engaged with coupling portions of the second engaging portion.

5. The electrical interconnection device as claimed in claim 1, wherein an L-shaped arm portion is connected to a back edge of the first engaging portion, wherein the positioning member is formed at a free end of the arm portion.

6. An electrical interconnection device, comprising:

a first connector;

a second connector electrically connected to the first connector via a number of wires;

a hinge member utilized to link the first and second connector such that the first and second connector capable of swiveling respect to one another;

a positioning member integrated with the hinge member, said positioning member selectively engaged with corresponding positioning grooves defined in one of the first and second connectors; and a cover partially enclosing the first and second connectors;

wherein the cover includes a first shield part and a second shield part, wherein the first and second shield part both have a number of walls together enclosing a receiving space;

wherein the hinge member includes a first engaging portion connected with a second engaging portion, wherein the first engaging portion is fastened to the first connector and the second engaging portion is pivotally coupled to the second connector;

wherein the second connector includes a base portion and the positioning grooves defined in peripheral side of the base portion;

wherein the base portion of the second connector is located in first concaves defined in rear walls of the first and second shield parts, and stoppers respectively formed on inner sides of a top and bottom walls of the first shield part and a second shield part, wherein the base portion of the second connector relies against the stoppers.

7. The electrical interconnection device as claimed in claim 6, wherein the hinge member engages with the first shield part.

8. The electrical interconnection device as claimed in claim 6, wherein the first connector has a metallic shell engaging with the second shield part.

9. The electrical interconnection device as claimed in claim 6, wherein two cam portions are arranged at lateral sides of the base portion and pivotally engaged with coupling portions of the second engaging portion of the hinge member.

10. The electrical interconnection device as claimed in claim 9, wherein the coupling portions are connected to the first engaging portion of the hinge member.

11. The electrical interconnection device as claimed in claim 10, wherein the coupling portions are located in second concaves defined in rear walls of the first and second shield parts.

* * * * *